US010661407B2

(12) United States Patent
Valentini

(10) Patent No.: US 10,661,407 B2
(45) Date of Patent: May 26, 2020

(54) HAND-HELD AND HAND-GUIDED POWER TOOL HAVING A WORKING ELEMENT RELEASABLY ATTACHED THERETO, AND FOR SUCH A POWER TOOL

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 0 days.

(21) Appl. No.: 16/360,569

(22) Filed: Mar. 21, 2019

(65) Prior Publication Data

US 2019/0291233 A1 Sep. 26, 2019

(30) Foreign Application Priority Data

Mar. 21, 2018 (EP) ..... 18163121

(51) Int. Cl.
*B24B 23/04* (2006.01)
*B24B 45/00* (2006.01)
*B24B 23/03* (2006.01)

(52) U.S. Cl.
CPC ..... *B24B 23/04* (2013.01); *B24B 23/03* (2013.01); *B24B 45/006* (2013.01)

(58) Field of Classification Search
CPC ..... B24B 23/04; B24B 23/02; B24B 23/00
USPC ..... 451/357, 359, 344
See application file for complete search history.

(56) References Cited

U.S. PATENT DOCUMENTS 5,018,314 A * 5/1991 Fushiya ..... B24B 23/03 451/344
5,441,450 A * 8/1995 Fein ..... B24B 23/00 451/344
5,679,066 A * 10/1997 Butz ..... B24B 23/03 451/344
8,678,884 B2 * 3/2014 Tanimoto ..... B24B 47/12 310/49.06

FOREIGN PATENT DOCUMENTS

EP 0623422 A1 11/1994

OTHER PUBLICATIONS

English language Abstract of EP0623422A1.

* cited by examiner

*Primary Examiner* — Robert A Rose
(74) *Attorney, Agent, or Firm* — Ware, Fressola, Maguire & Barber LLP

(57) ABSTRACT

A hand-held machine tool (1) for sanding or polishing a workpiece features a housing (2); a motor (4) for rotating a tool shaft (5) of the machine tool about its axis of rotation (6); and a backing pad (3) for releasable attachment of a sanding or polishing element thereto and eccentrically attachable to the tool shaft by an eccentric element (11) to allow the backing pad to perform a working movement. The machine tool implements different working movements of the backing pad attached thereto. The housing includes first magnetic elements (16) facing the backing pad. The backing pad attached to the eccentric element includes second magnetic elements (17) facing the housing. The machine tool (Continued)

implements a first working movement if a magnetic force is active between some first and second magnetic elements and a second working movement if no magnetic force is active between the first and second magnetic elements.

20 Claims, 7 Drawing Sheets

HAND-HELD AND HAND-GUIDED POWER TOOL HAVING A WORKING ELEMENT RELEASABLY ATTACHED THERETO, AND FOR SUCH A POWER TOOL

BACKGROUND OF THE INVENTION

1. Field of the Invention

The present invention refers to a hand-held machine tool for sanding or polishing a workpiece. The machine tool comprises a housing, a motor for actuating a tool shaft of the machine tool and for making the tool shaft rotate about its axis of rotation, and a backing pad for releasable attachment of a sanding element or a polishing element thereto and eccentrically attachable to the tool shaft by means of an eccentric element in such a way as to allow the backing pad to perform a working movement. The machine tool is adapted for realizing two different types of working movements of the backing pad attached thereto.

2. Brief Description of the Related Art

Conventional machine tools have a backing pad which performs only one certain type of working movement depending on the type of connection or coupling of the backing pad to the motor shaft by means of a gear transmission and/or an eccentric element or the like. For example, orbital sanders or polishers with a backing pad performing a purely orbital working movement, random orbital sanders or polishers with a backing pad performing a random orbital working movement or rotational sanders or polishers with a backing pad performing a purely rotational working movement are well-known in the art. For each desired type of working movement of the backing pad a separate machine tool is required.

The backing pad seen in a plan view may have almost any form. In particular, it may have a circular, rectangular, quadratic or triangle form. The backing pad may comprise a planar base plate made of a rigid material, a planar absorption plate attached to a bottom surface of the base plate, for example by means of an injection molding process, and made of a resilient material, and a sanding or polishing element (e.g. an abrasive sheet or polishing material) releasably attached to a bottom surface of the absorption plate, for example by means of a hook-and-loop (Velcro®) fastener. The planar base plate may comprise a stabilizing insert made, for example, of metal. Of course, other embodiments of the backing pad are possible, too.

Furthermore, machine tools are known in the art, which is adapted for realizing two different types of working movements of the backing pad attached thereto. For example, a dual-action sander named "Dynabrade Dynalocke®" is available on the market. This sander has a pneumatic motor and is adapted for realizing two different types of working movements of the backing pad attached thereto, namely a random orbital and a purely rotary working movement. The sander has a mechanical rotational switch located on the top of its housing and accessible from outside the housing. The switch can be manually actuated by a user of the tool, thereby switching between the random orbital and the purely rotational working movement of the backing pad.

The known sander has a couple of disadvantages: First of all, the switch for selecting the desired type of working movement acts on a mechanical gear arrangement located inside the housing and coupling the motor shaft to the backing pad. In order to avoid damage to the gear arrangement and/or other components of the machine tool, the tool and the motor, respectively, have to come to a complete standstill before the switch can be actuated by the user. Further, the purely rotational working movement is not very efficient and requires a particularly powerful motor in order to compensate for any power losses of the backing pad, or the backing pad will operate in the rotational working movement with reduced power only. Finally, the mechanical gear arrangement being switchable between two different types of working movements of the backing pad is complex in its mechanical construction, heavy in its weight, and due to its sophisticated construction not very robust and rather expensive.

SUMMARY OF THE INVENTION

Starting from the known machine tool of the above identified kind, which is adapted to perform two different types of working movements of the backing pad, it is an object of the present invention to suggest an improved machine tool capable of performing two different types of working movements of the backing pad attached thereto. In particular, it is an object to realize a machine tool with an enhanced practical benefit for users.

In accordance with the present invention this object is achieved by a machine tool comprising the features of claim 1. In particular, it is suggested that the housing of the machine tool comprises a plurality of first magnetic elements facing the backing pad, and that a backing pad attached to the eccentric element comprises a plurality of second magnetic elements facing the housing, and wherein the machine tool is adapted for realizing a first type of working movement if a magnetic force is active between at least some of the first and second magnetic elements and a second type of working movement if no magnetic force is active between the first and second magnetic elements.

Accordingly, the present invention suggests a hand-held machine tool for sanding or polishing a workpiece and adapted for provoking two different types of working movements of the backing pad attached thereto. The machine tool can be easily switched between the two types of working movements thereby provoking the backing pad to move with the desired type of working movement. The machine tool according to the present invention is particularly simple in its construction, light in its weight, robust and inexpensive. All these advantages are achieved by means of the magnetic elements provided in the housing and the backing pad, respectively, and by means of the magnetic force acting between these magnetic elements or not. Further, the machine tool according to the present invention requires only a small amount of maintenance because no mechanical gear arrangement is required for switching between the two types of working movements. In order to change the machine tool or the backing pad's working movement, respectively, from one type of working movement to another the user simply has to take appropriate measures that a magnetic force is active between the first and second magnetic elements or not. These appropriate measures can be realised in many different ways, which will be explained in more detail below.

Depending on whether there is a magnetic force acting between the magnetic elements the backing pad performs a first or second type of working movement. The various types of working movements can differ from one another by different characteristics, e.g. they can be purely rotational, purely orbital, random orbital or gear driven working movements and they can differ from one another by degree or magnitude of an orbit. Preferably, the two types of working movements comprise a purely orbital movement and a random orbital movement.

In particular, if the magnetic force acts between the first and second magnetic elements the backing pad performs the first working movement, in which the backing pad is prevented from rotating about its longitudinal axis in respect to the rest of the machine tool. In that case the backing pad performs a working movement provoked by the eccentric element without any rotational movement about its longitudinal axis. In particular, the first working movement is a purely orbital movement. If there is no magnetic force acting between the first and second magnetic elements the backing pad may be freely rotatable about its longitudinal axis. In that case the backing pad performs a working movement comprising a superposition of a movement provoked by the eccentric element about the tool shaft's axis of rotation and a free rotational movement about the backing pad's longitudinal axis. In particular, the second working movement is a random orbital movement.

The magnetic force acting between the first and second magnetic elements during the first type of working movement must be large enough to assure that the backing pad is securely held in a certain rotational position during operation of the machine tool, in particular that it does not execute a rotational movement about its longitudinal centre axis, but rather a purely orbital movement. Despite the magnetic force acting between the first and second magnetic elements (and also between the housing and the backing pad) the backing pad can still perform the first type of working movement. To this end, a gap may be provided between a top surface of the backing pad and a bottom side of the housing providing clearance and allowing a free working movement of the backing pad in respect to the housing. The gap may be at least partly bridged by means of a hood or cap attached to the housing and having an essentially annular form. The hood or cap serves for enhancing dust extraction capability of the machine tool during its intended use and/or for slowing down a rotational movement of the backing pad about its longitudinal axis during the intended use of the machine tool in one or both of the possible types of working movements.

Of course, the magnetic elements do not necessarily have to be located inside the housing and the backing pad, respectively. It is understood that the first magnetic elements are associated with the housing in one way or another and the second magnetic elements are associated with the backing pad. How and where the magnetic elements are fixed to the housing and the backing pad, respectively, is of no account for a proper functioning of the present invention. For example, the first magnetic elements may be located in or at the hood or cap attached to the bottom side of the housing, the hood or cap bridging the gap between the housing and the backing pad.

Further, the magnetic force does not necessarily have to be effective between all magnetic elements of the housing and the backing pad, respectively. It would be sufficient if during the first type of working movement at least one of the first magnetic elements associated with the housing interacts with at least one corresponding second magnetic element associated with the backing pad. In order to securely inhibit the rotation of the backing pad during the first type of working movement it is suggested that there are at least two, preferably three first magnetic elements associated with the housing which interact with a corresponding number of second magnetic elements associated with the backing pad.

According to a preferred embodiment of the present invention it is suggested that the machine tool is adapted for realizing the first type of working movement if the backing pad with the plurality of second magnetic elements facing the housing is attached to the eccentric element and for realizing the second type of working movement if another backing pad without second magnetic elements is attached to the eccentric element. In this case the appropriate measures to be taken by the user for switching between the different types of working movements simply consist in mounting different types of backing pads to the eccentric element, a first type of backing pad provided with the second magnetic elements and a second type of backing pad without such second magnetic elements. Preferably, the first magnetic elements provided in the housing of the machine tool are embodied as permanent magnets. Permanent magnets create a static magnetic field and are made of, for example, magnetized low carbon steel, cobalt, nickel, a ferrite or a Rare Earth Element.

However, the first magnetic elements could also be embodied as solenoids. In that case the machine tool could be adapted for realizing the first type of working movement if the solenoids are activated and generate a magnetic force acting on at least some of the second magnetic elements of the backing pad attached to the eccentric element and for realizing a second type of working movement if the solenoids are deactivated and generate no or only a very small magnetic force, without impact on the second magnetic elements of the backing pad. In this case the appropriate measures to be taken by the user for switching between the different types of working movement simply consist in electrically activating or deactivating the solenoids constituting the first magnetic elements of the housing. No switching of a mechanical gear transmission or the like is required.

In an electric machine tool powered by an electric motor electricity is available for energising the solenoids. However, in pneumatic machine tools powered by a pneumatic motor there is usually no electricity available. In that case, electricity for energising the solenoids could be provided by a rechargeable battery located inside the tool's housing. Alternatively or additionally, a dynamo or generator could be provided in the tool's housing, which is actuated by the rotating parts of the machine tool, for example the motor shaft, and which generates electricity for energising the solenoids. The electricity generated by the dynamo or generator may be directly provided to the solenoids or buffered in a rechargeable battery or capacitor.

According to another preferred embodiment of the invention, the second magnetic elements are embodied as permanent magnets or pieces of ferromagnetic material. If the second magnetic elements are embodied as permanent magnets, they should have a polarity opposite to the polarity of the first magnetic elements. The ferromagnetic elements could be made, for example, of low carbon steel, cobalt, nickel or a ferrite, and are adapted to magnetically interact with the first magnetic elements. A ferromagnetic element is attracted by a magnetic element if it is located in a magnetic field generated by the magnetic element. Preferably, the ferromagnetic elements do not create their own magnetic field. In those cases, where the backing pad or its planar base plate, respectively, comprises a stabilizing insert made of metal, the metal insert could constitute or act as the ferromagnetic elements.

The number of first magnetic elements provided in the housing and second magnetic elements provided in the backing pad may be identical or may differ from one another. Preferably, the number of first magnetic elements is larger than the number of second magnetic elements. In particular, it is suggested that the number of first magnetic elements is an integer multiple of the number of second magnetic elements. The number of second magnetic elements may be an even or an uneven number. It is suggested that the number of second magnetic elements is at least two, preferably at least three. Having a lower number of second magnetic elements associated with the backing pad reduces the orbiting masses of the backing pad, thereby providing for a steadier and calmer operation of the machine tool without or with very little vibrations.

Further, it is suggested that the backing pad attached to the eccentric element is able to freely rotate about its longitudinal centre axis in respect to the eccentric element, the longitudinal axis of the backing pad being spaced apart from and running essentially parallel to the axis of rotation of the tool shaft. In particular, the backing pad is freely rotatable about its longitudinal axis when the machine tool is not in use, i.e. in its idle state. Of course, the free rotation of the backing pad may be slightly reduced by a hood or cap, if such is mounted, bridging a gap between the bottom side of the housing and the top surface of the backing pad. Preferably, the backing pad is attached to a rotary element in a torque proof manner in respect to the longitudinal axis. The rotary element may be attached to the eccentric element freely rotatable about the longitudinal axis. Advantageously, the torque proof attachment of the backing pad to the rotary element is realized by positive locking in a plane extending essentially perpendicular in respect to the longitudinal axis and the backing pad is releasably fixed to the rotary element in the direction of the longitudinal axis by means of a screw or by means of magnetic force. The magnetic force could be the magnetic force acting between the first and second magnetic elements or a different magnetic force acting between other magnetic elements, which are not the first and second magnetic elements. A magnetic attachment of a backing pad to the rest of a machine tool is described in enabling detail in a EP application to the same inventor as the present invention and having the application number EP 18 155 369.4.

According to another preferred embodiment of the present invention it is suggested that the first magnetic elements of the housing are located around the axis of rotation of the tool shaft, the first magnetic elements each having the same given distance to the axis of rotation. Preferably, the first magnetic elements are circumferentially evenly spaced apart from one another and have the same distances in a circumferential direction in respect to each of their neighbouring first magnetic elements. However, for various reasons it could also be possible that the first magnetic elements are not evenly spaced apart from one another in a circumferential direction, e.g. for constructional reasons because other components or elements of the machine tool (e.g. fastening screws or counter weights) located at the bottom side of the tool's housing block or obstruct the respective space.

Accordingly, it is suggested that the second magnetic elements of the backing pad are located around a longitudinal centre axis of the backing pad, the second magnetic elements having the same given distance to the longitudinal axis. Preferably, the second magnetic elements are circumferentially evenly spaced apart from one another and have the same distances in a circumferential direction in respect to each of their neighbouring second magnetic elements. However, for various reasons it could also be possible that the second magnetic elements are not evenly spaced apart from one another in a circumferential direction, e.g. for constructional reasons because other components or elements of the backing pad (e.g. ventilation openings of a dust extraction system) located at the top surface of the backing pad block or obstruct the respective space.

Of course, the number, the magnetic characteristics, the dimensions and/or the positions of the first and/or second magnetic elements can be freely varied in order to achieve a desired strength of the magnetic force acting between the first and second magnetic elements. Preferably, the lines of magnetic flux of the magnetic field in the gap between the housing and the backing pad run perpendicularly to the oscillation plane of the backing pad during its intended use. The closer two opposing magnetic elements of the housing and the backing pad are located the larger the magnetic force is. Further, the larger the size of the surfaces of the magnetic elements facing each other is, the larger the magnetic force is. The magnetic susceptibility and the magnetic permeability are other characteristics of the magnetic elements, which can also influence the intensity and strength of the magnetic force.

It is further suggested that the positions of the first magnetic elements and of the second magnetic elements are such that the second magnetic elements face corresponding first magnetic elements in respective discrete rotational positions of the backing pad about its longitudinal axis. Preferably the sizes of surfaces of the first and second magnetic elements are designed such that during the first type of working movement the surfaces of the second magnetic elements are each in continuous coverage with the surfaces of corresponding first magnetic elements. During an orbital working movement of the backing pad the second magnetic elements are each in continuous orbital movement in the oscillation plane of the backing pad in respect to corresponding first magnetic elements. According to this embodiment the size of the surfaces of the first magnetic elements is larger than the size of the surfaces of the second magnetic elements in order to assure that, despite the orbital movement of the backing pad and the resulting movement of the second magnetic elements, the entire surfaces of the second magnetic elements always face surfaces of corresponding first magnetic elements. With the term "surfaces" the active surfaces of the magnetic elements are meant, which extend essentially parallel to the oscillation plane of the backing pad. To this end, also solenoids may have "surfaces" in the sense of the invention.

According to a preferred embodiment of the invention it is suggested that the surfaces of the first and second magnetic elements have a circular form and a diameter of the surfaces of the first or second magnetic elements is at least the size of a diameter of the surfaces of the other (second or first, respectively) magnetic elements plus the orbit, which the backing pad performs during its purely orbital movement. By doing so a continuous coverage of the surfaces of the first and second magnetic elements during the orbital movement of the backing pad can be assured. For example, if the surfaces of the second magnetic elements have a diameter of 10 mm each and the backing pad has an orbit diameter of 4 mm (the orbit diameter is twice the distance or eccentric offset between the rotational axis of the tool shaft and the longitudinal axis of the backing pad), the surfaces of the first magnetic elements have a diameter of at least 14 mm (10 mm+4 mm). Likewise, if the diameter of the surfaces of the first magnetic elements is 10 mm each, with a given orbit of 4 mm, the surfaces of the second magnetic elements have a diameter of at least 14 mm.

Further characteristics and advantages of the present invention are described hereinafter with reference to the accompanying drawings. The drawings show preferred embodiments of the present invention without, however, limiting the invention to the described embodiments. The various features of the embodiments shown in the figures may be freely combined with one another even if not shown in the figures and/or not explicitly mentioned in the description.

DETAILED DESCRIPTION OF THE INVENTION

Figure 1:
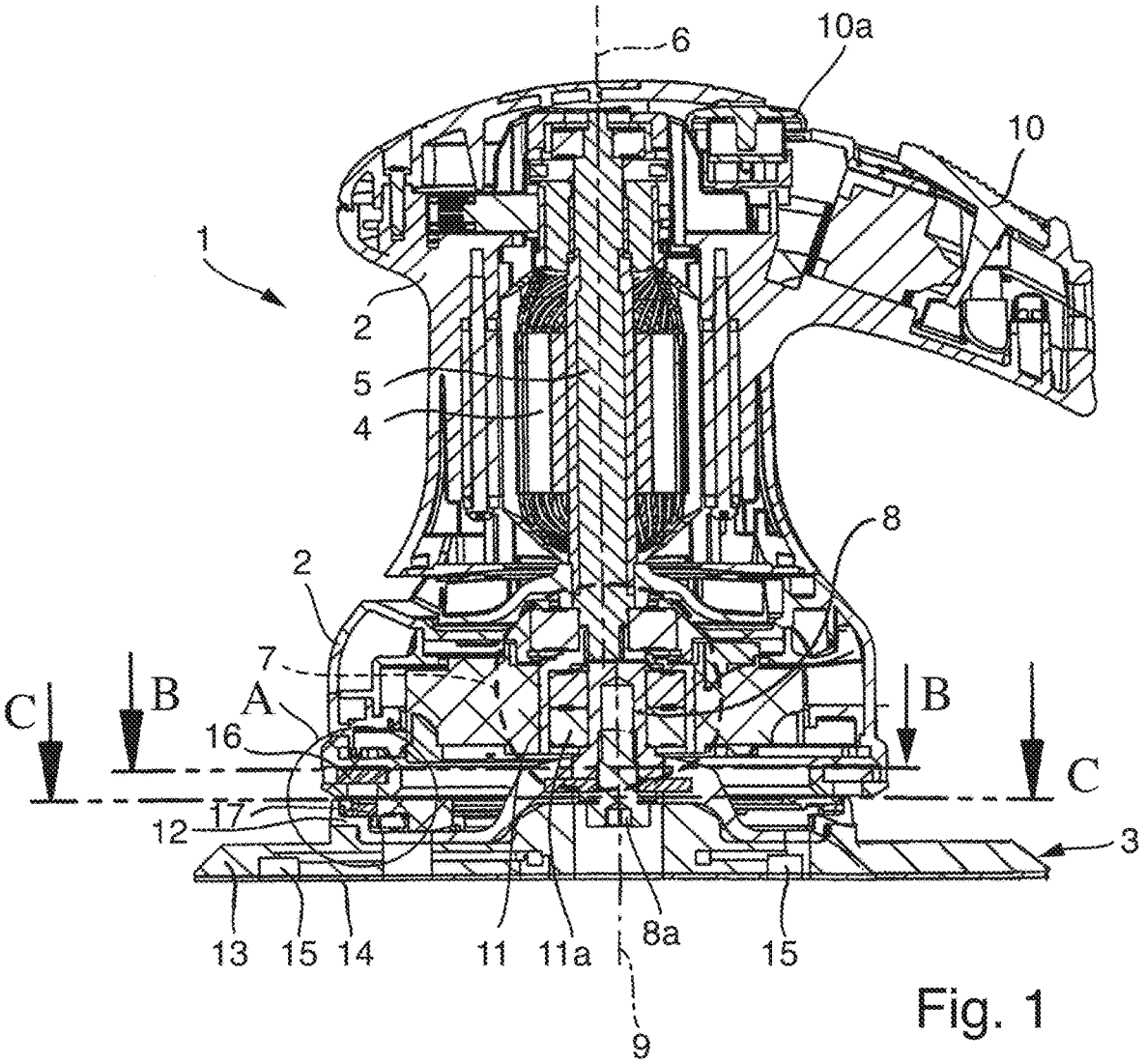
FIG. 1 a vertical cross section of a hand-held machine tool according to a first preferred embodiment of the invention.

With reference to the attached FIGS. 1 to 4 a first preferred embodiment of a hand-held and hand-guided machine tool 1 according to the present invention is described. The machine tool 1 comprises a housing 2 preferably made of a rigid plastic material. Of course, at least part of the housing 2 could be made of other materials, for example metal or carbon fibre. Preferably, part of the housing 2, where a user will grip the tool 1, is made of a resilient material, for example rubber or a soft plastic material. Further, the tool 1 comprises a backing pad 3 adapted for performing a working movement in respect to the housing 2. The machine tool 1 is adapted for making a backing pad 3 attached thereto perform at least two different types of working movements, which will be described in more detail below.

Within the housing 2 the tool 1 comprises a motor 4 with a motor shaft 5 adapted for performing a rotational movement about an axis of rotation 6. In this embodiment the motor 4 is an electric motor, preferably a BLDC-motor. Of course, it could also be embodied as a pneumatic motor. Further, means 7 for transforming the rotational movement of the shaft 5 into the desired working movement of the backing pad 3 are provided. In this embodiment the transforming means 7 comprise an eccentric element 11, which is attached to the motor shaft 5 in a torque proof manner. The eccentric element 11 includes a rotary element 8, which is supported by the eccentric element 11 freely rotatable about a longitudinal axis 9. To this end, the eccentric element 11 is provided with bearings 11*a* for supporting the rotary element 8. The rotary element 8 is located eccentrically to the motor shaft 5, which can be seen by the displacement of the rotational axis 6 and the longitudinal axis 9 running essentially parallel to one another. The backing pad 3 can be easily mounted and fixed to the rotary element 8 by means of a screw 8*a*, which passes through a through-hole provided in the centre of the backing pad 3 and which is screwed into a threaded bore provided in the rotary element 8. The connection between the backing pad 3 and the rotary element 8 is preferably torque-proof in the oscillation plane of the backing pad 3 running essentially perpendicular to the axes 6, 9. Alternatively, the backing pad 3 could also be held to the rotary element 8 by means of magnetic force. Of course, the transforming means 7 could comprise any other kind of gear mechanism, too.

Further, the tool 1 comprises a switch 10 for activating/deactivating the tool 1 (or its motor 4, respectively) and a knurled wheel 10*a* for controlling the speed of the motor 4 (or of the working movement of the backing pad 3, respectively). The backing pad 3 preferably comprises a planar base plate 12 made of a rigid material, a planar absorption plate 13 attached to a bottom surface of the base plate 12 and made of a resilient material, and an abrasive or polishing sheet 14 detachably attached to a bottom surface of the absorption plate 13, for example by means of a hook-and-loop fastener. Holes 15 are provided in the absorption plate 13 and in the sheet 14 in order to allow the extraction of dust from the working surface.

The backing pad 3 is supported by the eccentric element 11 such that it is able to rotate about its longitudinal axis 9. In order to enable the machine tool 1 to realize two different types of working movements of the backing pad 3, it is suggested that the housing 2 comprises a plurality of first magnetic elements 16 facing the backing pad 3 and the backing pad 3 comprises a plurality of second magnetic elements 17 facing the housing 2. The two different types of working movements of the backing pad 3 are realized depending on whether a magnetic force is active between at least some of the first and second magnetic elements 16, 17 or not. In particular, an active magnetic force will impair the free rotation of the backing pad 3 about its longitudinal axis 9 and hold the backing pad 3 in a defined rotational position about the longitudinal axis 9. If the magnetic force is strong enough, it will prevent the backing pad 3 from rotating about the longitudinal axis 9. With the magnetic force active, the backing pad 3 will perform a first type of working movement, in particular a purely orbital movement about the axis of rotation 6. With no magnetic force active, free rotation of the backing pad 3 about the longitudinal axis 9 is enabled and the backing pad 3 will perform a second type of working movement, in particular a random orbital movement.

All a user of the machine tool 1 has to do in order to change the type of working movement of the backing pad 3 is to take appropriate measures to activate or deactivate the magnetic force acting between the magnetic elements 16, 17. This can be achieved by many different ways, two of which are described in further detail herein.

Figure 2:
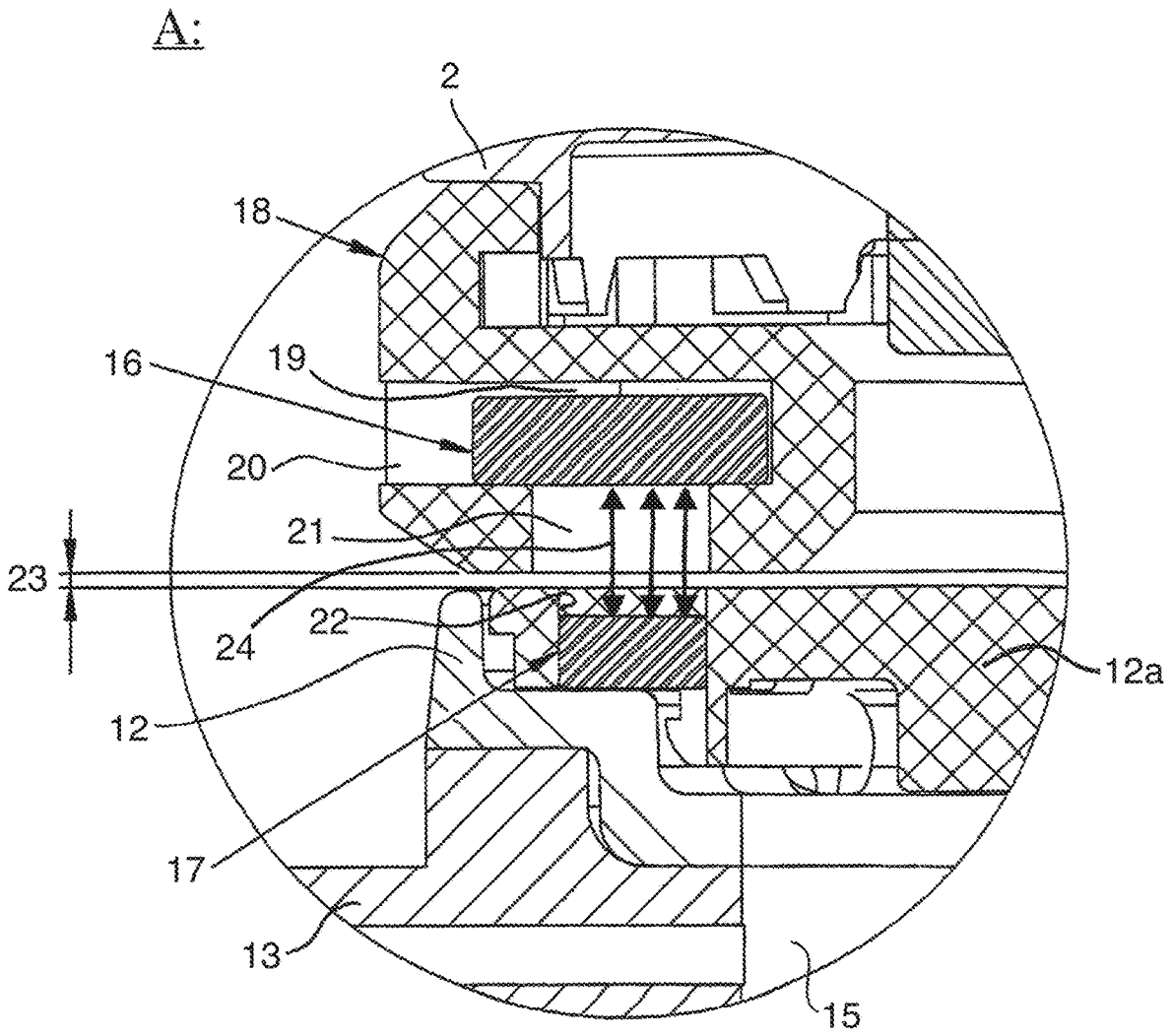
FIG. 2 a detail A of the machine tool of FIG. 1.

A detailed view of the tool 1 of FIG. 1 in the region where the magnetic force acts between the housing 2 and the backing pad 3 (detail A) is shown in FIG. 2. A gap 23 is provided between the housing 2 and the backing pad 3 in order allow a working movement of the backing pad 3 in respect to the housing 2. The lines of magnetic flux of a magnetic field 24, which is built up between the magnetic elements 16, 17, run across this gap 23, preferably perpendicular in respect to the areal extension of the gap 23 and in respect to the oscillation plane of the backing pad 3. The magnetic field 24 is strong enough to generate a magnetic force, which can securely hold the backing pad 3 in a certain rotational position in respect to the housing 2 and which prevents the backing pad 3 from freely rotating about the longitudinal axis 9. Despite the magnetic forces acting between the magnetic elements 16, 17 the backing pad 3 can still perform the first type of working movement, in particular an orbital movement, provoked by the eccentric element 11 rotating about the rotational axis 6.

It can be seen from FIG. 2 that a first magnetic element 16 is attached to the housing 2. It may be connected to the housing 2 directly or indirectly by means of one or more additional elements 18 (for example made of metal or plastic material) which are connected to the housing 2. A hood or cap made of rubber or soft plastic material and bridging the gap 23 along the circumference of the housing 2 could be an example for such an additional element 18. The hood or cap 18 comes very close to the top surface of the backing pad 3 and, therefore, is particularly well suited for attachment of the first magnetic elements 16. The magnetic elements 16 are each inserted into a receiving cavity 19 through an opening 20 from the side. The cavity 19 is located in the additional element 18 but could just as well be located in the housing 2 itself. After having reached its working position, the magnetic element 16 can be fixed within the cavity 19, for example by an adhesive. An opening 21 below the magnetic element 16 is directed towards the backing pad 3 and serves for allowing the magnetic force to better interact with the corresponding second magnetic element 17 of the backing pad 3 and for having access to the first magnetic element 16, for example for removing it from the cavity 19, if necessary.

The second magnetic element 17 can be fixed to any part of the backing pad 3. In this embodiment, it is fixed indirectly to the planar base plate 12 by means of one or more additional elements 12*a* made of a rigid material. However, it would also be possible to fix the magnetic element 17 directly to or within the rigid base plate 12. The second magnetic element 17 is inserted into a cavity from the top through an opening 22. The cavity is located in the additional element 12*a* or the base plate 12. After insertion of the magnetic element 17 the opening 22 may be closed. This can be achieved by means of a suitable plug element or by injecting a plastic material into the cavity through the opening 22. Closing of the opening 22 has the advantage that the magnetic element 17 is fixedly secured within the backing pad 3 and that humidity, dust and dirt are prevented from entering into the cavity and contacting the second magnetic element 17. It is preferred that the magnetic elements 17 are inserted into the backing pad 3 during its production, for example by means of injection molding, so no additional manufacturing step is necessary for fixing the magnetic elements 17 to the backing pad 3 and for closing the openings 22.

The second magnetic element 17 may be a permanent magnet or a ferromagnetic element. The ferromagnetic element may be a small and light weight plate made of low carbon steel or a similar material with good ferromagnetic properties. It would be even possible that the rigid base plate 12 is made of metal which at least partly acts as a ferromagnetic element forming the second magnetic element 17. If the second magnetic elements 17 are embodied as permanent magnets they should have an opposite polarity to the first magnetic elements 16.

According to the embodiment of FIGS. 1 to 4 it is suggested that the machine tool 1 is adapted for realizing the first type of working movement if the backing pad 3 with the plurality of second magnetic elements 17 facing the housing 2 is attached to the eccentric element 11 and for realizing a second type of working movement if another backing pad without second magnetic elements is attached to the eccentric element 11. In this case the appropriate measures to be taken by the user for switching between the different types of working movements simply consist in mounting different types of backing pads 3 to the eccentric element 11, a first type of backing pad 3 provided with the second magnetic elements 17 (see FIG. 4) and a second type of backing pad without such second magnetic elements (not shown). In this embodiment the first magnetic elements 16 provided in the housing 2 are embodied as permanent magnets. Permanent magnets create a static magnetic field and are made of, for example, magnetized low carbon steel, cobalt, nickel, a ferrite or a rare earth element.

Figure 3:
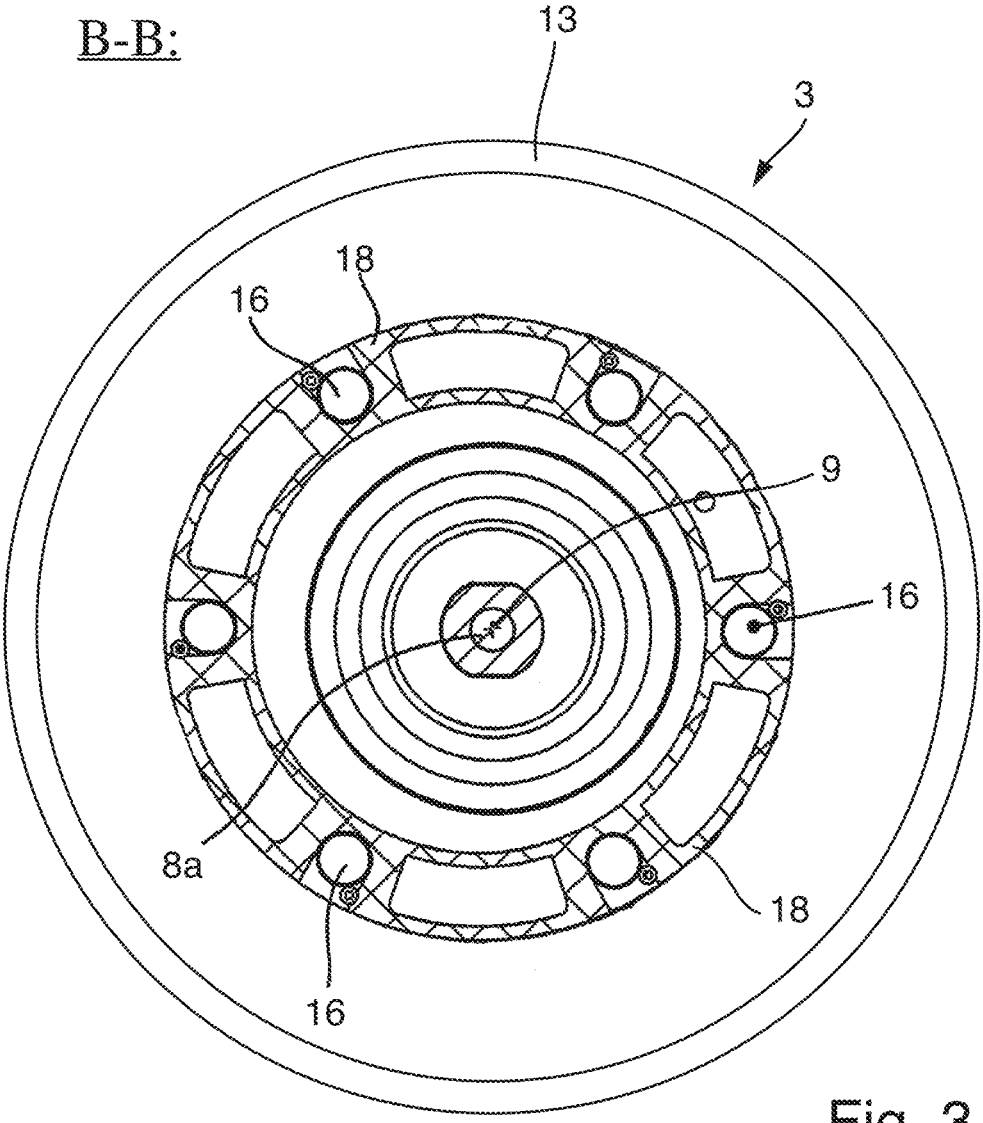
FIG. 3 a horizontal cross section along line B-B of the machine tool of FIG. 1.

FIG. 3 shows a sectional view of the machine tool 1 of FIG. 1 in the plane B-B. It can be seen that the backing pad 3 has a circular shape. The section runs through the additional element 18 (e.g. the hood or cap) associated to the housing 2. It can be seen that there are a total of six first magnetic elements 16 associated to the housing 2. The magnetic elements 16 are located around the axis of rotation 6 each having the same given distance to the axis 6 and being circumferentially evenly spaced apart from one another. Of course, the circumferential distance between neighbouring permanent elements 16 could also vary.

Figure 4:
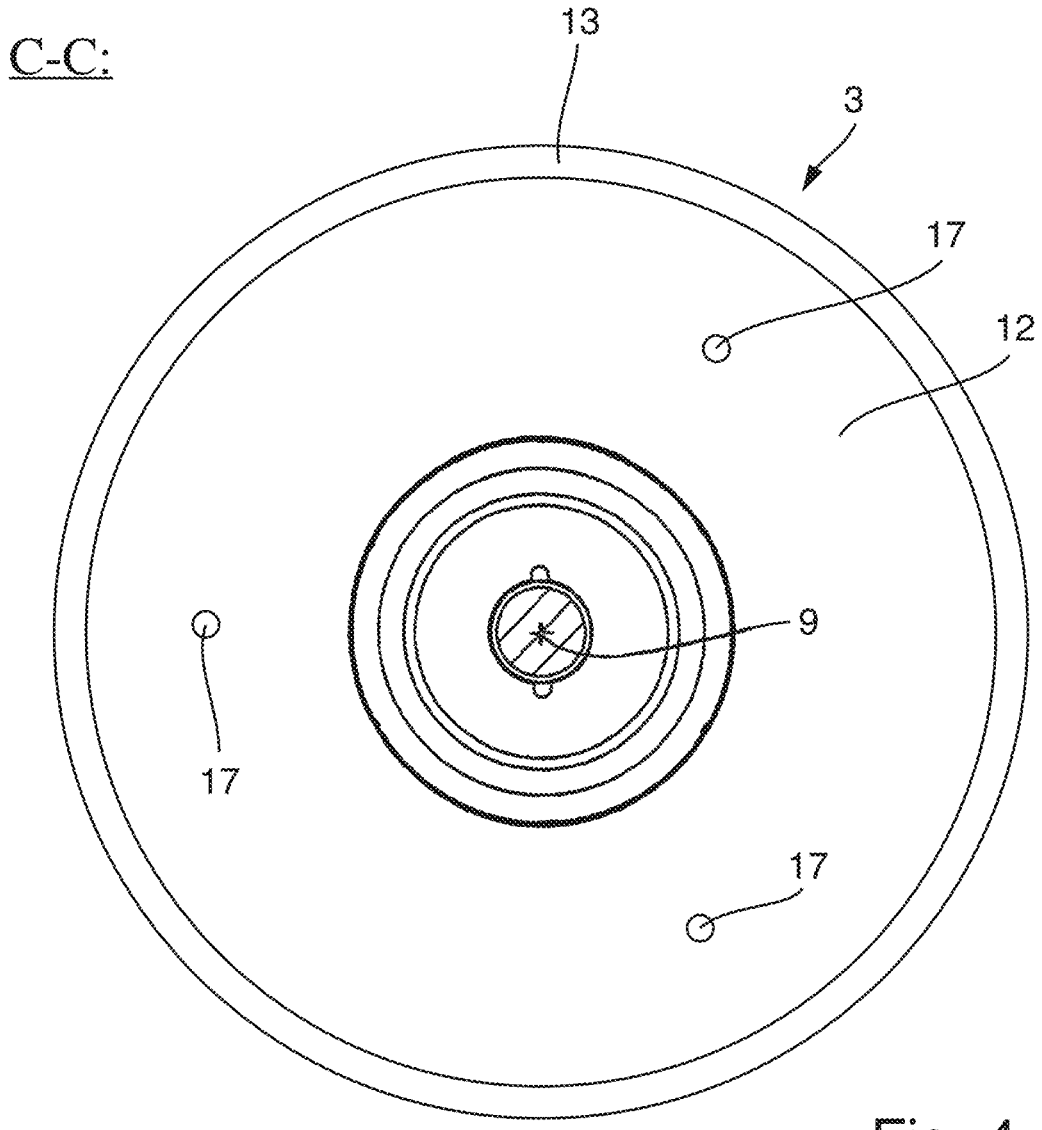
FIG. 4 a horizontal cross section along line C-C of the machine tool of FIG. 1 with a first type of backing pad mounted thereto.

FIG. 4 shows a sectional view of the machine tool 1 of FIG. 1 in the plane C-C. Part of the top surface of the backing pad 3 can be seen. The section runs through a central part of the planar base plate 12 of the backing pad 3. It can be seen that there are a total of three second magnetic elements 17 associated to the backing pad 3. The magnetic elements 17 are located around the longitudinal axis 9 each having the same given distance to the longitudinal axis 9 and being circumferentially evenly spaced apart from one another.

Figure 5:
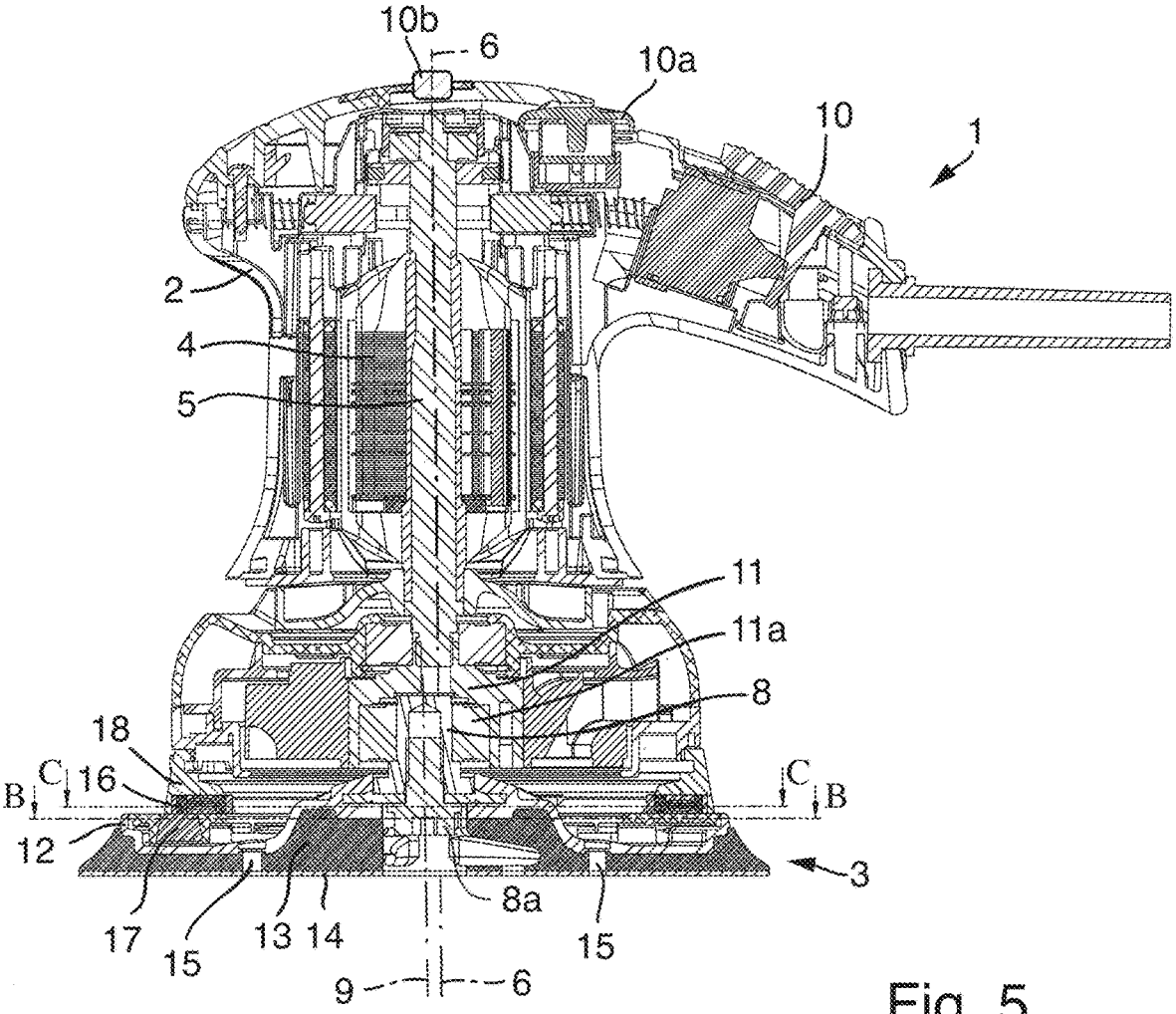
FIG. 5 a vertical cross section of a hand-held machine tool according to a second preferred embodiment of the invention.
Figure 6:
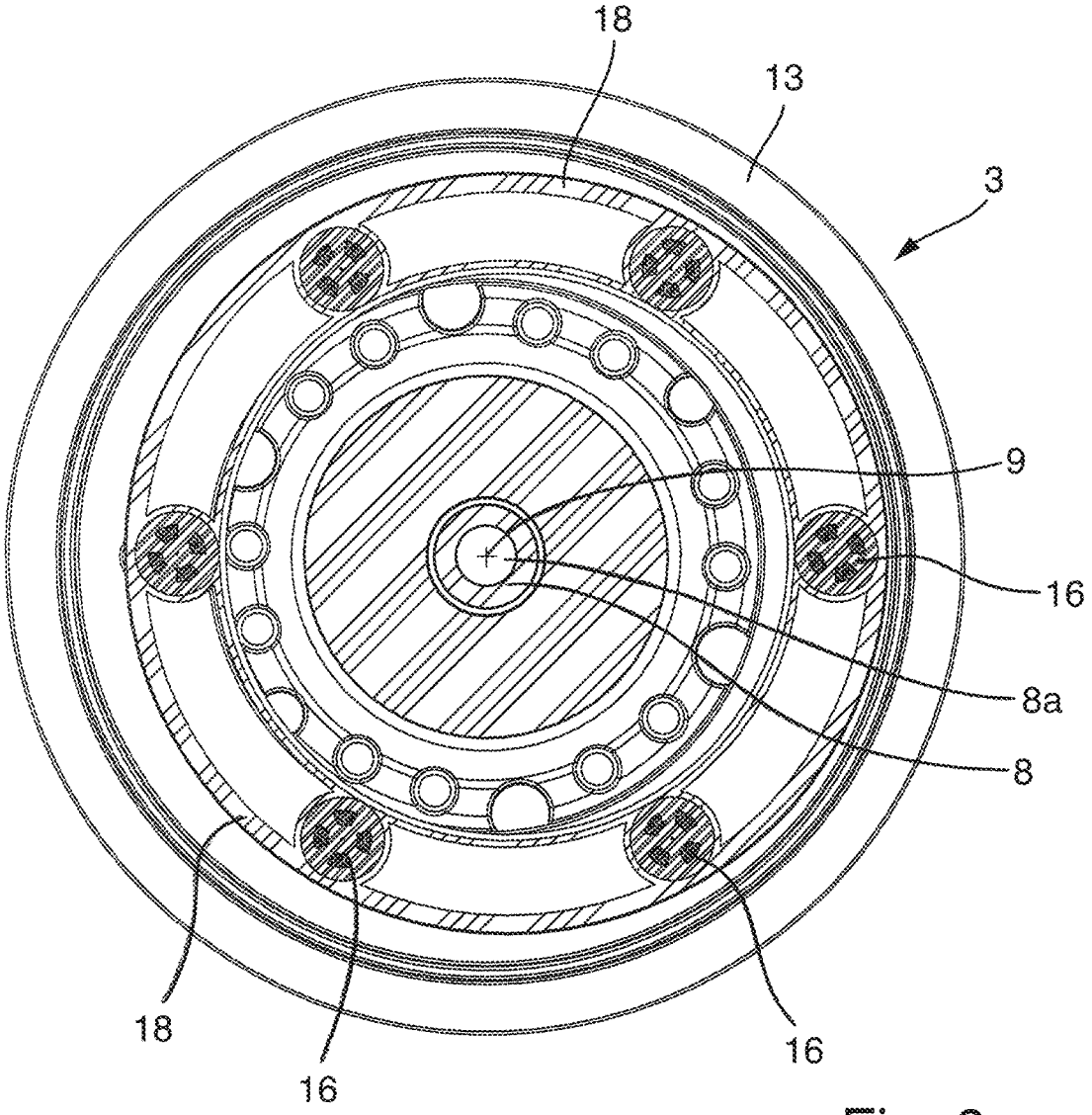
FIG. 6 a horizontal cross section along line C-C of the machine tool of FIG. 5.

According to an alternative embodiment of the invention shown in FIGS. 5 and 6, the first magnetic elements 16 are embodied as solenoids (electromagnets), which can be electrically activated and deactivated thereby provoking them to create a magnetic field 24 or not. In that case the machine tool 1 is adapted for realizing the first type of working movement if the solenoids 16 are activated and generate a magnetic force acting on at least some of the second magnetic elements 17 of the backing pad 3 attached to the eccentric element 11 and for realizing a second type of working movement if the solenoids 16 are deactivated and generate no or only a very small magnetic force, without impact on the second magnetic elements 17 of the backing pad 3. In this case the appropriate measures to be taken by the user for switching between the different types of working movements simply consist in electrically activating or deactivating the solenoids 16 constituting the first magnetic elements of the housing 2. This can be effected by any type of switching means 10*b*, for example a mechanical or an electric switch, a rotary switch, a push button, a virtual switch on a touch sensitive display or the like. The switching means 10*b* can be located at any position of the housing 2 accessible from outside the housing 2. In the embodiment of FIG. 5 the switching means 10*b* are located at the top side of the housing 2. No switching of a mechanical gear transmission or the like is required for changing the type of working movement.

FIG. 6 shows a sectional view through the machine tool 1 of FIG. 5 along the line C-C. The second magnetic elements 17 embodied as solenoids and located in the hood or cap 18 can be clearly seen. Of course, the solenoids 17 could also be provided inside the housing 2, in particular along the bottom surface of the housing 2. In the electric machine tool 1 powered by the electric motor 4 electricity is available for energising the solenoids 16. However, in pneumatic machine tools powered by a pneumatic motor there is usually no electricity available. In that case, electricity for energising the solenoids 16 could be provided by a rechargeable battery located inside the tool's housing 2.

Alternatively, a dynamo or generator could be provided in the tool's housing 2, which is actuated by the rotating parts of the machine tool 1, for example the motor shaft 5, and which generates electricity for energising the solenoids 16. The electricity generated by the dynamo or generator may be directly provided to the solenoids 16 or buffered in a rechargeable battery or capacitor.

The number, the magnetic characteristics, the dimensions and/or the positions of the first and/or second magnetic elements 16, 17 can be freely varied in order to achieve a desired strength of the magnetic force acting between the first and second magnetic elements 16, 17. The magnetic susceptibility and the magnetic permeability are other characteristics of the magnetic elements 16, 17, which can also influence the intensity and strength of the magnetic force. The individual properties of the magnetic elements 16, 17 can be adapted depending on the design of the respective machine tool 1 and the individual operating conditions.

Figure 7:
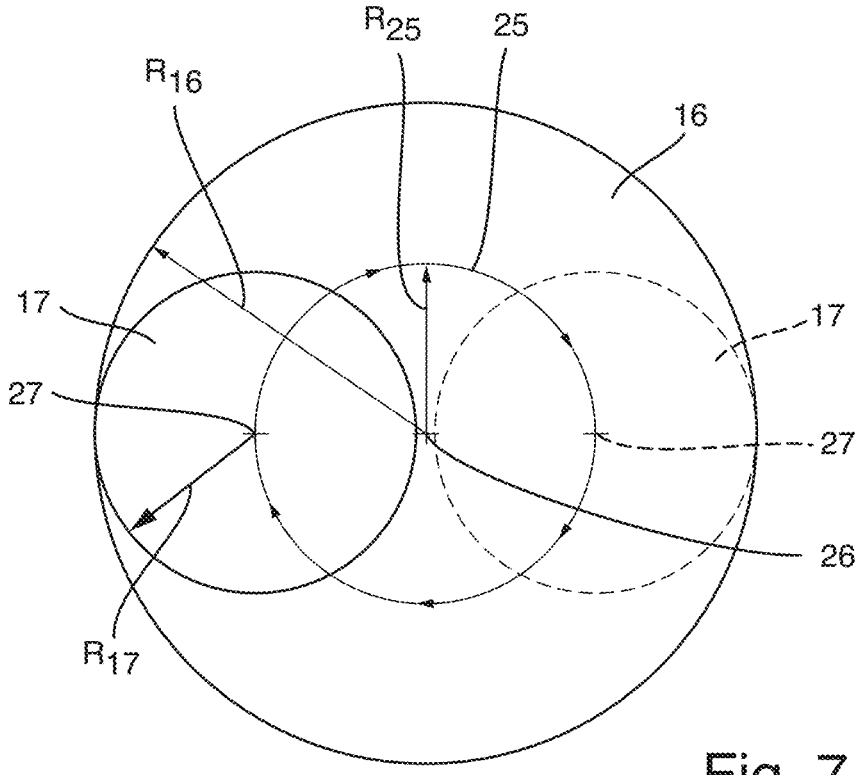
FIG. 7 a top view on a first magnetic element and a second magnetic element during a first type of working movement.

During a purely orbital working movement of the backing pad 3 each of the second magnetic elements 17 of the backing pad 3 performs an orbital movement in respect to the corresponding first magnetic element 16 of the housing 2. This is explained in further detail with reference to FIG. 7, which shows a first magnetic element 16 and the corresponding second magnetic element 17 performing an orbital movement 25 about the centre 26 of the first magnetic element 16 during the orbital working movement of the backing pad 3. During the orbital movement 25 of the second magnetic element 17 its centre 27 rotates on a circle corresponding to the orbital movement 25. The diameter of the orbital movement 25 corresponds to twice the distance (indicated with $R_{25}$) between the rotational axis 6 of the motor shaft 5 and the longitudinal axis 9 of the backing pad 3. The first and second magnetic elements 16, 17 have a circular active surface. The first magnetic element 16 has a radius of $R_{16}$ and the second magnetic element 17 has a radius of $R_{17}$. In this embodiment, the radius $R_{16}$ of the first magnetic element 16 is the radius $R_{17}$ of the second magnetic element 17 plus the distance $R_{25}$ ($R_{16}>=R_{17}+R_{25}$) or larger. With other words, the diameter of the surface of each of the first magnetic elements 16 is at least the size of a diameter ($2\times R_{17}$) of the surface of the corresponding second magnetic element 17 plus the orbit diameter $2\times R_{25}$. This assures that during the orbital movement 25 of the backing pad 3 the surfaces of the second magnetic elements 17 are each in continuous coverage with the surfaces of the corresponding first magnetic elements 16. Likewise, this could be achieved if the diameter of the surface of each of the second magnetic elements 17 is at least the size of a diameter ($2\times R_{16}$) of the surface of the corresponding first magnetic element 16 plus the orbit diameter $2\times R_{25}$.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

The invention claimed is:

1. Hand-held machine tool (1) for sanding or polishing a workpiece, the hand-held machine tool (1) comprising:

a housing (2), a motor (4) for actuating a tool shaft (5) of the hand-held machine tool (1) and for making the tool shaft (5) rotate about its axis of rotation (6), and a backing pad (3) for releasable attachment of a sanding element or a polishing element thereto and eccentrically attachable to the tool shaft (5) by means of an eccentric element (11) in such a way as to allow the backing pad (3) to perform a working movement, wherein the hand-held machine tool (1) is adapted for realizing two different types of working movements of the backing pad (3) attached thereto, wherein the housing (2) of the hand-held machine tool (1) comprises a plurality of first magnetic elements (16) facing the backing pad (3), and that the backing pad (3) attached to the eccentric element (11) comprises a plurality of second magnetic elements (17) facing the housing (2), and wherein the hand-held machine tool (1) is adapted for realizing a first type of working movement if a magnetic force is active between at least some of the plurality of the first and second magnetic elements (16, 17) and a second type of working movement if no magnetic force is active between the plurality of the first and second magnetic elements (16, 17).

2. Hand-held machine tool (1) according to claim 1, wherein the hand-held machine tool (1) is adapted for realizing the first type of working movement if the backing pad (3) with the plurality of second magnetic elements (17) facing the housing (2) is attached to the eccentric element (11) and the second type of working movement if another backing pad (3) without the plurality of the second magnetic elements (17) is attached to the eccentric element (11).

3. Hand-held machine tool (1) according to claim 2, wherein the plurality of the first magnetic elements (16) is embodied as permanent magnets.

4. Hand-held machine tool (1) according to claim 1, wherein the plurality of the first magnetic elements (16) is embodied as solenoids, and wherein the hand-held machine tool (1) is adapted for realizing the first type of working movement if the solenoids (16) are activated and generate a magnetic force acting on at least some of the plurality of the second magnetic elements (17) of the backing pad (3) attached to the eccentric element (11) and a second type of working movement if the solenoids (16) are deactivated and generate no magnetic force.

5. Hand-held machine tool (1) according to claim 1, wherein the plurality of the second magnetic elements (17) is embodied as permanent magnets or pieces of ferromagnetic material.

6. Hand-held machine tool (1) according to claim 1, wherein the backing pad (3) attached to the eccentric element (11) is able to freely rotate about its longitudinal centre axis (9) in respect to the eccentric element (11), and wherein the longitudinal axis (9) of the backing pad (3) is spaced apart from and runs essentially parallel to the axis of rotation (6) of the tool shaft (5).

7. Hand-held machine tool (1) according to claim 6, wherein the backing pad (3) is attached to a rotary element (8) in a torque proof manner in respect to the longitudinal axis (9), and wherein the rotary element (8) is attached to the eccentric element (11) freely rotatable about the longitudinal axis (9).

8. Hand-held machine tool (1) according to claim 7, wherein the torque proof attachment of the backing pad (3)

to the rotary element (8) is realized by positive locking in a plane extending essentially perpendicular in respect to the longitudinal axis (9), and wherein the backing pad (3) is releasably fixed to the rotary element (8) in the direction of the longitudinal axis (9) by means of a screw (8*a*) or by means of magnetic force.

9. Hand-held machine tool (1) according to claim 6, wherein the second working movement is a random orbital movement.

10. Hand-held machine tool (1) according to claim 1, wherein the first working movement is a purely orbital movement, and wherein the backing pad (3) is held in a discrete rotational position in respect to the longitudinal axis (9) by means of magnetic force resulting from interaction between at least some of the plurality of the first and second magnetic elements (16, 17).

11. Hand-held machine tool (1) according to claim 1, wherein the plurality of the first magnetic elements (16) of the housing (2) are located around the axis of rotation (6) of the tool shaft (5), the plurality of the first magnetic elements (16) having the same given distance to the axis of rotation (6) and being circumferentially evenly spaced apart from one another.

12. Hand-held machine tool (1) according to claim 1, wherein the second magnetic elements (17) of the backing pad (3) are located around a longitudinal centre axis (9) of the backing pad (3), the plurality of the second magnetic elements (17) having the same given distance to the longitudinal axis (9) and being circumferentially evenly spaced apart from one another.

13. Hand-held machine tool (1) according to claim 1, wherein the positions of the plurality of the first magnetic elements (16) and of the plurality of the second magnetic elements (17) are such that in respective discrete rotational positions of the backing pad (3) at least some of the plurality of the second magnetic elements (17) face corresponding first magnetic elements (16).

14. Hand-held machine tool (1) according to claim 13, wherein sizes of surfaces of the plurality of the first and second magnetic elements (16, 17) are designed such that during a purely orbital movement of the backing pad (3) the surfaces of the plurality of the second magnetic elements (17) are each in continuous coverage with corresponding surfaces of the plurality of the first magnetic elements (16).

15. Hand-held machine tool (1) according to claim 14, wherein the surfaces of the plurality of the first and second magnetic elements (16, 17) have a circular form, and a diameter ($2\times R_{16}$; $2\times R_{17}$) of the surfaces of the plurality of the first or second magnetic elements (16; 17) is at least the size of a diameter ($2\times R_{17}$; $2\times R_{16}$) of corresponding surfaces of other second or first magnetic elements (17; 16) plus the size of the orbit ($2\times R_{25}$), which the backing pad (3) performs during its purely orbital movement.

16. Hand-held machine tool (1) according to claim 2, wherein the plurality of the second magnetic elements (17) is embodied as permanent magnets or pieces of ferromagnetic material.

17. Hand-held machine tool (1) according to claim 2, wherein the backing pad (3) attached to the eccentric element (11) is able to freely rotate about its longitudinal centre axis (9) in respect to the eccentric element (11), and wherein the longitudinal axis (9) of the backing pad (3) is spaced apart from and runs essentially parallel to the axis of rotation (6) of the tool shaft (5).

18. Hand-held machine tool (1) according to claim 7, wherein the second working movement is a random orbital movement.

19. Hand-held machine tool (1) according to claim 8, wherein the second working movement is a random orbital movement.

20. Hand-held machine tool (1) according to claim 2, wherein the first working movement is a purely orbital movement, and wherein the backing pad (3) is held in a discrete rotational position in respect to the longitudinal axis (9) by means of magnetic force resulting from interaction between at least some of the plurality of the first and second magnetic elements (16, 17).

* * * * *